US008397926B2

(12) United States Patent
Driver et al.

(10) Patent No.: US 8,397,926 B2
(45) Date of Patent: Mar. 19, 2013

(54) NURSING BOTTLE ASSEMBLY AND A REUSABLE LINER THEREFOR

(75) Inventors: Matthew Gary Driver, Colne (GB); Thomas Robert Etienne Pellereau, Colne (GB); Raymond Liu Hon Wai, Colne (GB); Sher Hing Sum, Colne (GB)

(73) Assignee: Babisil Products (UK) Co. Ltd., Colne (GB)

( * ) Notice: Subject to any disclaimer, the term of this patent is extended or adjusted under 35 U.S.C. 154(b) by 488 days.

(21) Appl. No.: 12/601,269

(22) PCT Filed: Jun. 5, 2008

(86) PCT No.: PCT/GB2008/001906

§ 371 (c)(1),
(2), (4) Date: Apr. 22, 2010

(87) PCT Pub. No.: WO2008/149087

PCT Pub. Date: Dec. 11, 2008

(65) Prior Publication Data

US 2010/0193460 A1 Aug. 5, 2010

(30) Foreign Application Priority Data

Jun. 6, 2007 (CN) ..... 2007 2 0148195 U

(51) Int. Cl.
*A61J 9/00* (2006.01)
*A61J 11/00* (2006.01)

(52) U.S. Cl. ..... 215/11.3; 215/11.1; 215/11.6

(58) Field of Classification Search ..... 215/11.1, 215/11.3, 11.6
See application file for complete search history.

(56) References Cited

U.S. PATENT DOCUMENTS

| | | | | |
|---|---|---|---|---|
| 2,876,113 | A * | 3/1959 | Barton | 426/117 |
| 3,163,544 | A * | 12/1964 | Valyi | 426/112 |
| 3,223,289 | A * | 12/1965 | Bouet | 222/209 |
| 3,627,161 | A * | 12/1971 | Wergeland | 215/11.6 |
| 5,497,911 | A * | 3/1996 | Ellion et al. | 222/95 |
| 6,517,878 | B2 * | 2/2003 | Heczko | 426/112 |
| 6,737,091 | B1 * | 5/2004 | Littell, II | 426/117 |
| 6,994,225 | B2 * | 2/2006 | Hakim | 215/11.4 |
| 7,036,975 | B2 * | 5/2006 | Renz | 366/130 |

(Continued)

FOREIGN PATENT DOCUMENTS

| | | | |
|---|---|---|---|
| FR | 2779946 | A | 12/1999 |
| GB | 1332175 | A | 10/1973 |
| KR | 2007 0091254 | A | 9/2007 |
| SU | 1718934 | A1 | 3/1992 |

OTHER PUBLICATIONS

Database WPI Week 199307, Thomson Scientific, London, GB; AN 1993-056710 XP002495563.

*Primary Examiner* — Tri Mai
(74) *Attorney, Agent, or Firm* — Egbert Law Offices, PLLC

(57) ABSTRACT

A nursing bottle assembly includes a rigid outer casing, a flexible inner liner and a teat arrangement. The teat arrangement attaches to the outer casing and secures the inner liner in position within the outer casing. The flexible inner liner includes a container in the form of a bellows such that it expands and collapses in a predictable linear manner along its longitudinal axis. Preferably, the inner liner is moulded from a food-grade silicone or thermoplastic elastomer and includes a substantially cylindrical container formed with at least one projecting rib or groove about which the liner folds to enable it to expand and collapse in a predictable linear manner along its longitudinal axis.

17 Claims, 8 Drawing Sheets

U.S. PATENT DOCUMENTS

| | | | | |
|---|---|---|---|---|
| D551,899 | S * | 10/2007 | Roehrig | D7/376 |
| 2003/0024895 | A1* | 2/2003 | Meyers et al. | 215/11.5 |
| 2006/0065232 | A1* | 3/2006 | Wurtz et al. | 123/204 |
| 2006/0078656 | A1* | 4/2006 | Manning et al. | 426/117 |
| 2007/0181520 | A1* | 8/2007 | Holley et al. | 215/11.1 |
| 2008/0041807 | A1* | 2/2008 | Tominaga | 215/11.3 |
| 2008/0142467 | A1* | 6/2008 | Giles et al. | 215/11.3 |

* cited by examiner

NURSING BOTTLE ASSEMBLY AND A REUSABLE LINER THEREFOR

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a nursing bottle assembly for use primarily, but not exclusively, in feeding babies and infants and to a reusable liner therefor.

2. Description of Related Art Including Information Disclosed Under 37 CFR 1.97 and 37 CFR 1.98

Nursing bottle assemblies conventionally comprise a rigid outer casing with a teat arrangement secured on top to enclose the feed. One problem with rigid bottles is the tendency for the baby to ingest air. This ingested air can cause excessive wind and extreme discomfort for the baby. The conventional solution to this problem is to provide a bottle with a disposable flexible inner liner that is used to contain the feed. The inner liner collapses as the feed is taken which reduces the pressure required and the amount of air gulped as the baby sucks on the teat. The collapsing action reduces air ingestion and more naturally mimics the action of the breast. Some bottles with disposable liners can be used in any orientation as the feed is held in contact with the teat no matter the angle of bottle or baby. This is beneficial as it allows babies to feed from any angle but requires the air in the liner and teat to be fully expelled once the bottle is assembled prior to use. Typically, this is done by manually squeezing the liner after final assembly of bottle. However, squeezing the liner in this way can cause it to collapse unpredictably so that pockets of milk form within the liner resulting in the milk supply to the baby being stopped. A further problem is that air can be drawn back into the bottle through the hole in the teat when the baby is not feeding. One solution to these problems is described in WO 2004/098486 which uses a manual plunger mechanism that expels the air from the liner and prevents it from being drawn back in. However, it is necessary for the position of the plunger to be continually adjusted during feeding, which increases the complexity of the assembly by introducing moving parts and makes the assembly more difficult to use.

The use of an inner, flexible liner in a bottle assembly can also result in other problems during feeding. Existing liners prevent the formula milk from being mixed in the liner so that a separate vessel is required for mixing. It is also difficult to measure the amount of feed in a conventional liner part way through a feed as the liner collapses unpredictably. In addition, thin flexible liners may twist as they collapse, thereby cutting off the supply of feed to the teat. This problem is unpredictable and causes frustration for both baby and parent.

The object of the present invention is to provide a nursing bottle assembly which overcomes or substantially mitigates the aforementioned problems.

BRIEF SUMMARY OF THE INVENTION

According to a first aspect of the present invention there is provided a nursing bottle assembly comprising a rigid outer casing, a flexible inner liner and a teat arrangement which attaches to the outer casing and secures the inner liner in position within the outer casing, the flexible inner liner comprising a container in the form of a bellows such that it expands and collapses in a predictable manner along its longitudinal axis.

Preferably, the inner liner comprises a substantially cylindrical container formed with at least one projecting rib or groove about which the liner folds to enable it to expand and collapse in a predictable manner along its longitudinal axis.

Preferably also, the inner liner comprises a series of parallel, annular projecting ribs between which the liner bulges in the opposite direction to define a series of bulging portions. Each of these bulging portions preferably has a volume of between 28 ml and 32 ml when the liner is expanded. Preferably also, the annular ribs project inwardly of the liner and the liner bulges outwardly between the ribs.

In another embodiment, the inner liner comprises a single projecting rib that spirals around the liner and defines a single spiral portion that bulges in the opposite portion. In yet a further embodiment, the inner liner defines one or more portions of reduced or increased wall thickness in the form of one or more grooves or ridges formed respectively in the liner wall. These are preferably provided as a series of annular grooves or ridges located alternately on the inside and on the outside of the liner.

Preferably also, the liner is moulded from a food-grade silicone or a food-grade thermoplastic elastomer (TPE). Feeds cannot be heated whilst in conventional flexible liners owing to the materials from which they are made because they can cause leaching of chemicals into the feed. This also means that such liners cannot be sterilized satisfactorily so that the liner must be thrown away after a single use. This makes conventional bottle assemblies expensive to use and environmentally unfriendly. However, the use of a liner which is made of silicone or a thermoplastic elastomer in a bottle assembly according to the invention overcomes all of these problems.

Preferably also, the liner comprises a depending flange around its rim that fits into a channel formed around an upper rim of the casing so that the liner is suspended from and hangs down into the casing when the bottle assembly is upright.

Preferably also, the teat assembly comprises a teat and a sealing ring and, when the bottle assembly is upright, the top of the liner defines a flat annular surface over which a rim of a teat is located and held in position by the sealing ring which is detachably secured to the casing. Advantageously, the sealing ring screws to a thread formed in the exterior surface of the casing to compress the rims of the liner and the teat to form a liquid-tight joint.

Preferably also, the surfaces of the liner adjacent the rim of the teat and/or the upper rim of the casing are profiled to increase the frictional engagement of the liner with the teat and/or the casing respectively. Alternatively, the depending flange of the liner defines one or more cut-outs in which one or more projections on the casing engage to prevent relative rotation between the liner and the casing when the sealing ring is secured to the casing.

Preferably also, the teat assembly comprises a teat defining a nipple with a Y-shaped slit. In addition, the teat preferably comprises an areola portion surrounding the nipple that is dimpled or otherwise textured.

Preferably also, the casing is tubular and the bottle assembly comprises a base that is detachably connected to a lower rim of the casing when the bottle assembly is upright. Advantageously, the base is snap-fitted or screwed to the lower rim of the casing.

Preferably also, the bottle assembly comprises a cap which fits over the teat and push-fits around the sealing ring. Advantageously, the cap is shaped with tapering sides such that at least an upper part thereof has a diameter less than the diameter of the casing in order that it can be inserted into the lower rim of the casing to exert pressure on the lining Preferably also, the cap can be inverted and attached to the lower rim of the casing to form a stand for the bottle assembly into which the inner liner can extend below the level of the lower rim of the casing.

In another embodiment of the invention, the casing is at least partially collapsible along its longitudinal axis. Preferably, it comprises a plurality of sections that are connected together and that can nest telescopically within one another as the lining collapses. Alternatively, it is capable of collapsing and expanding in the manner of a bellows such that it can hold its shape at any particular stage during the collapsing or expanding process.

Other features of the first aspect of the present invention are described in the dependent claims appended hereto.

According to a second aspect of the present invention there is provided a flexible inner liner comprising a container in the form of a bellows that expands and collapses in a predictable linear manner along its longitudinal axis for use in a bottle assembly according to the first aspect of the present invention.

Preferably, the liner is provided pre-sterilized and compressed in combination with a pre-sterilized teat in a case for subsequent use with a bottle assembly according to the first aspect of the present invention.

BRIEF DESCRIPTION OF THE SEVERAL VIEWS OF THE DRAWINGS

The various aspects of the present invention will now be described by way of example with reference to the accompanying drawings.

DETAILED DESCRIPTION OF THE INVENTION

Figure 1:
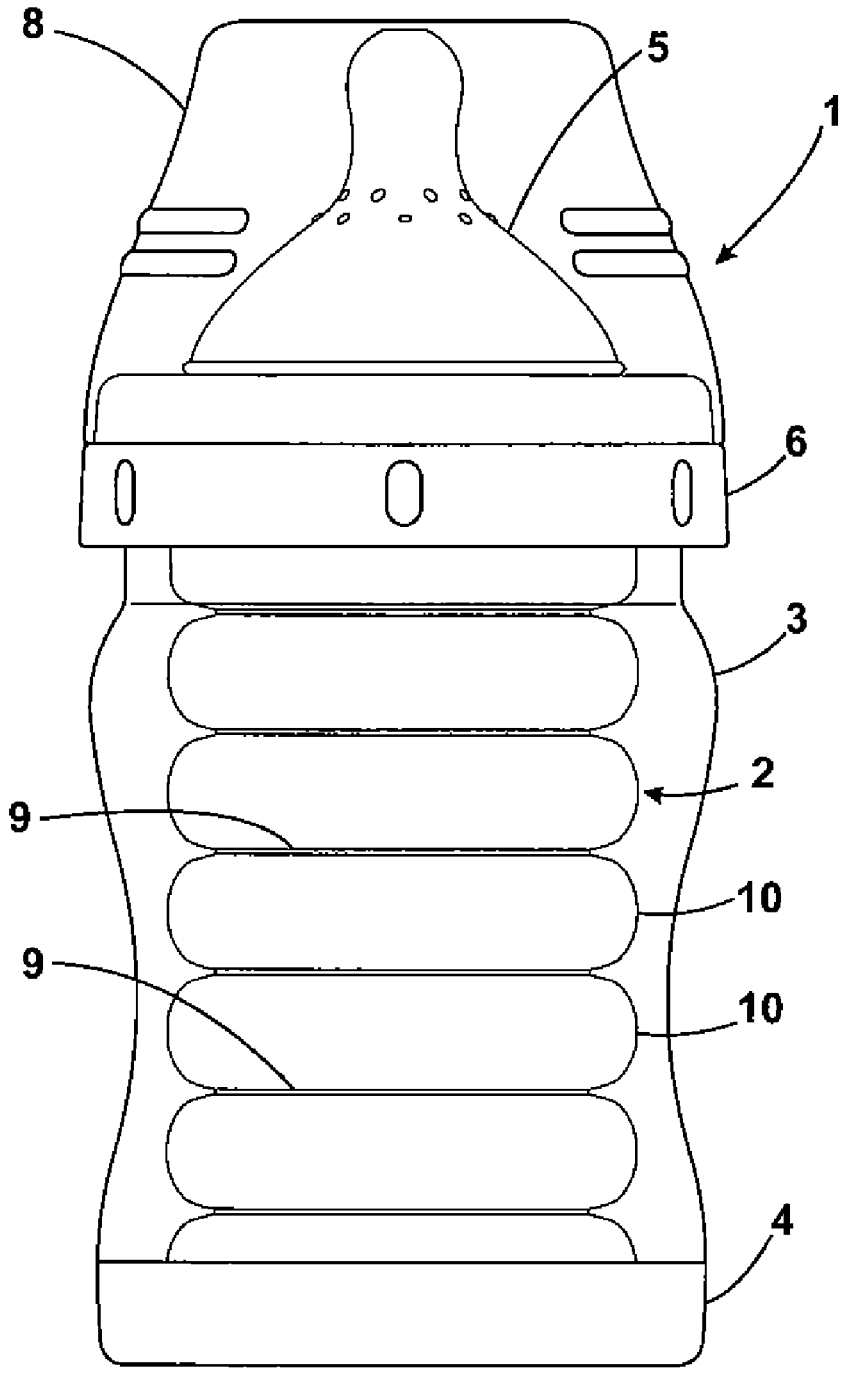
FIG. 1 is a side elevation view of a nursing bottle assembly shown assembled ready for use.
Figure 2:
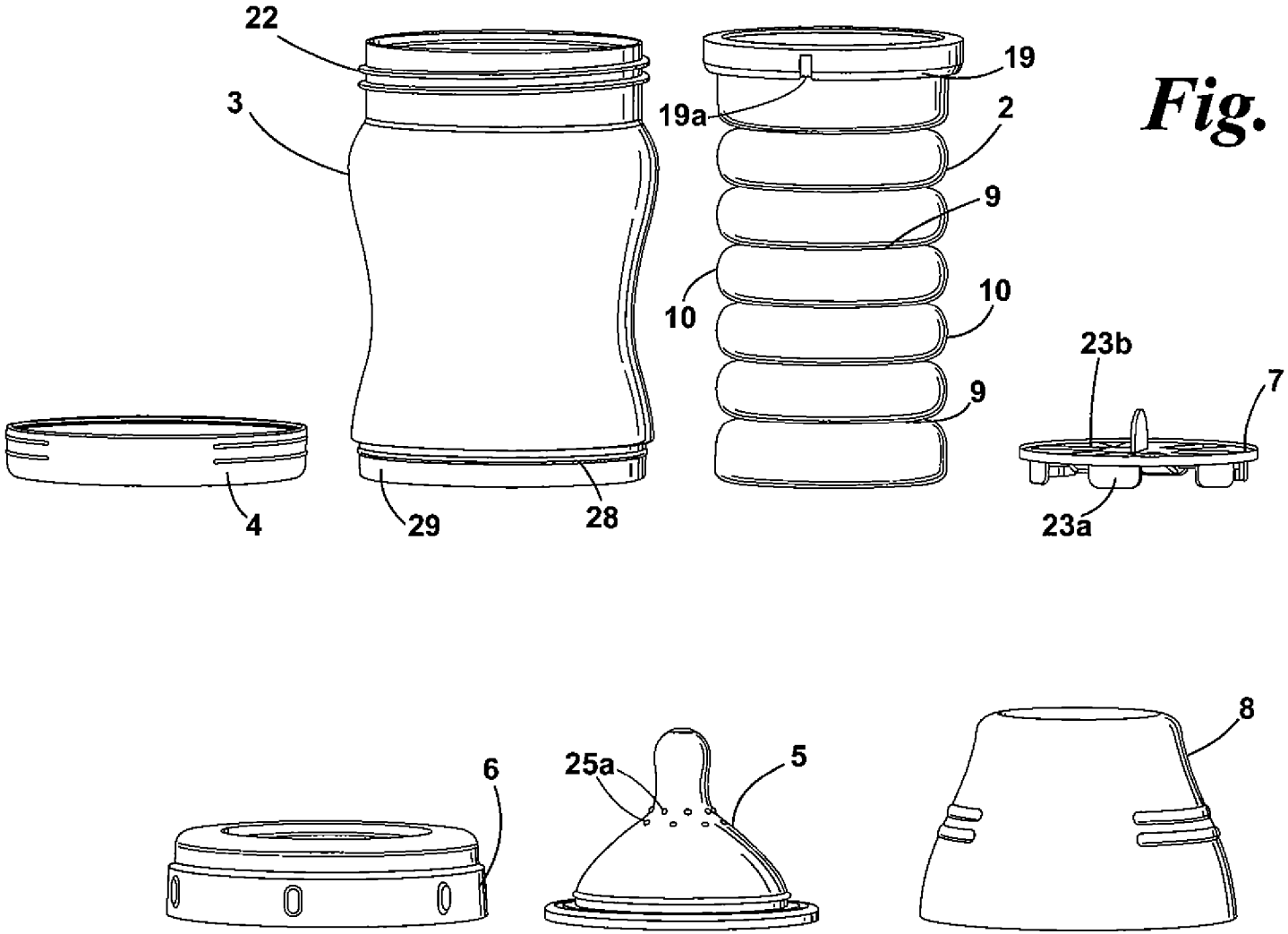
FIG. 2 is an exploded perspective view of each of the elements of the assembly shown in FIG. 1 laid side by side.

As shown in FIGS. 1 and 2, a nursing bottle assembly 1 comprises a flexible inner liner 2 for use in holding a feed that is retained, in use, within a rigid outer casing 3 in the form of a tube to which a detachable base 4 is fitted. The upper part of the liner 2 is fitted to the casing 3 and a teat 5 is located over the liner in the manner of a lid and secured thereto and to the casing 3 by a sealing ring 6. Optionally, a mixing device in the form of a swirler 7 can be located between the liner 2 and the teat 6 if the feed comprises a powdered milk formula. A seal cap 8 that can be secured to the casing 3 to cover the teat 5 then completes the assembly. Apart from the liner 2 and the teat 5, the rest of the assembly, which does not contact the feed, can be made from a rigid plastics material such as a polycarbonate or similar plastic that facilitates sterilization in a conventional manner. The casing 3 and the seal cap 8 can be made transparent so that the liner 2 and teat 5 can be seen and the amount of feed therein viewed. The various parts of this assembly and the way that they fit to the other parts will now be described in more detail.

The inner liner 2 comprises a flexible, substantially cylindrical container that is preferably moulded from a food-grade silicone or a food-grade thermoplastic elastomer (TPE). This makes the liner 2 soft and floppy whilst being strong and capable of withstanding high temperatures. This means that the liner can be sterilized by boiling in water or by being treated in a microwave oven. In the former case, if an electric sterilization equipment is used the liner can withstand contact with the high temperature of an electrical element without damage. In addition, the liner 2 can be readily turned inside out to facilitate cleaning, for example to rinse away particles of powdered milk formula, prior to sterilization. The use of such a liner also means that the feed never comes into contact with any plastics material that may contain chemicals such as bisphenol-A, phthalates or oestrogen that can leach into the feed over time. Liners 2 can be made with various levels of transparency or colour. These levels of transparency or colours may be provided within an individual liner 2 that can vary along its length or circumference. Additives could also be added that change the colour or transparency of the liner with changes in temperature, pressure or stress so as to communicate this information to the user or increase the aesthetic properties of the liner 2.

In the embodiment shown in FIGS. 1 and 2, the liner 2 comprises a substantially cylindrical container that is corrugated along its length in the manner of a bellows with a series of parallel, annular ribs 9 that project inwardly of the liner 2 between which the liner 2 curves outwards to form a series of outwardly bulging portions 10. In the illustrated embodiment, each of these portions 10 is identical and has a volume, when expanded, of between 28 and 32 ml and preferably of around 30 ml (that is around 1 fluid ounce of liquid feed) so that the amount of feed or formula poured into the liner 2 can be readily calculated. This also enables the mount of feed remaining in a liner 2 during feeding to be readily calculated. It will be appreciated, therefore, that an advantage of moulding the liner 2 in this shape is that it will expand and collapse during use in a predictable manner, in particular along its longitudinal axis, without bulging substantially outwards or crumpling inwards. This means that, in use, it will neither twist nor crinkle, which can result in the supply of feed to the teat being cut off or the formation of milk pockets. In a collapsed state, the liner 2 is reduced in length to a fraction of its expanded size, the bulging portions 10 each collapsing about an annular, outwardly projecting, non-permanent fold at the centre of the bulging portion 10 as the liner 2 is emptied during use.

In a modification, the bottom of the liner 2 may also be profiled so that towards the end of a feed, the bottom of the liner 2 is sucked inwardly of the cylindrical sides of the liner 2 and up into the interior of the teat 5 so that all of a feed can be used. The bottom of the liner 2 may, therefore, be ridged or grooved to permit this to happen.

Figure 3C:
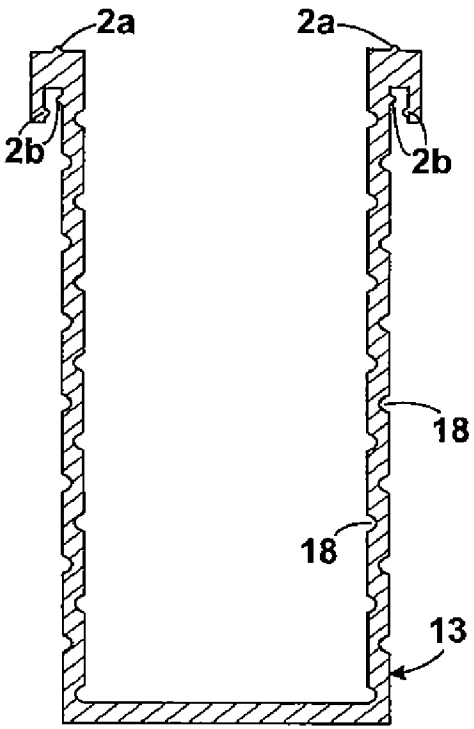
FIGS. 3*a* and 3*b* are schematic side elevations and FIG. 3*c* is a schematic longitudinal cross-section of different designs of inner liners for use with the assembly shown in FIGS. 1 and 2 in place of the inner liner shown therein.
Figure 3B:
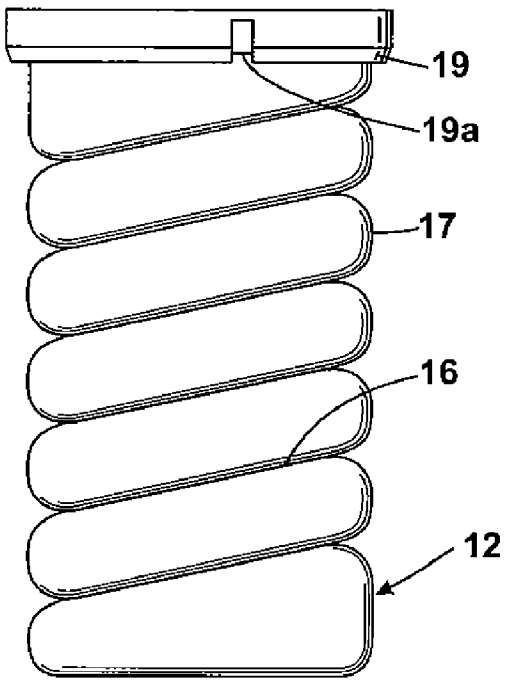
Figure 3A:
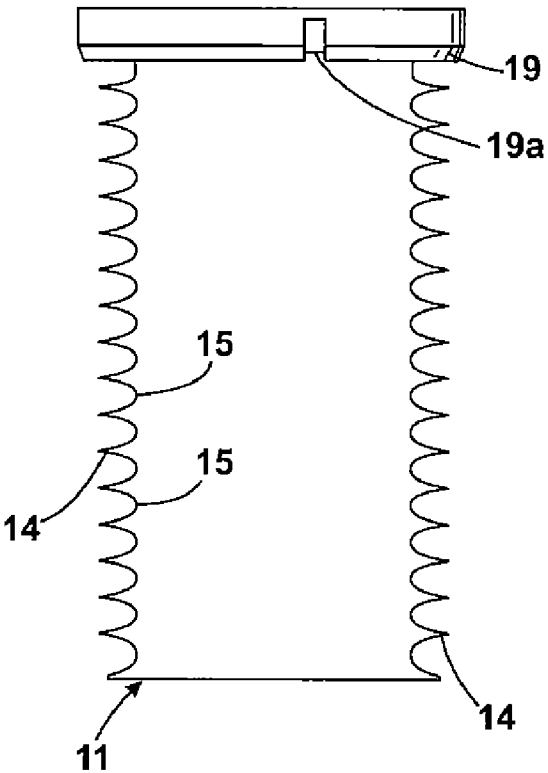

The shape of the liner 2 can differ from that shown in FIGS. 1 and 2 and yet still expand and collapse in a predictable manner along its longitudinal axis. Example of different shapes of liner 11, 12 and 13 are shown in FIGS. 3*a* to 3*c* respectively. The liner 11 shown in FIG. 3*a* resembles the liner 2 shown in FIGS. 1 and 2 as though it had been folded inside out. Hence, in this liner 11 annular ribs 14 project outwards whilst intermediate portions 15 bulge inwards. The liner 12 shown in FIG. 3*b* has a single rib 16 that spirals around the liner 12 to define a single spiral bulging portion 17. In all of these cases the liner 2 collapses by folding around the rib 16 or ribs 14 so that sections of the rib 16 or the individual ribs 14 move to lie closely adjacent to one another. In contrast, the liner 13 shown in cross-section in FIG. 3*c* does not have annular ribs but portions of reduced wall thickness in the form of parallel grooves 18 formed in the liner wall. These grooves 18 are also annular and in the illustrated embodiment are located alternately inside and outside the liner 13. Hence, as the liner 13 collapses it will fold along the lines of each groove 18 to define a bellows that will then further collapse in a predictable manner along its longitudinal axis. Portions of increased wall thickness in the form or a rib or ribs instead of the grooves 18 would also operate in a similar manner. Likewise, a single spiral groove on one side of the liner may also operate in a similar manner to the single spiral rib 14 of FIG. 3*b*.

Figure 4:
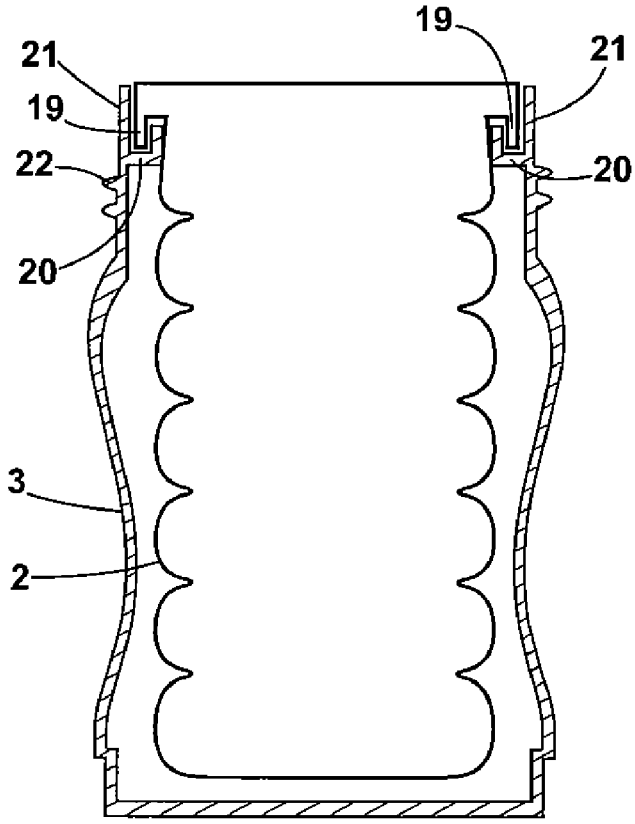
FIG. 4 is a schematic cross-section view of an inner liner and outer casing of the assembly shown in FIGS. 1 and 2 showing the fitment of the liner to the outer casing.

All of the liners shown in FIGS. 1 to 3 fit to the outer casing 3 in the same way. They are all provided with a depending flange 19 around their rim that fits into an internal channel 20 formed around the upper rim 21 of the casing 3, as shown in FIG. 4. This means that the liner 2 is suspended from the upper part of the casing 3 and hangs down into the casing 3 in use. In particular, the casing 3 supports the liner 2 during filling. This is important as the liner 2 is floppy and could otherwise be difficult to handle during a filling operation. In addition, the air gap between the outer surface of the liner 2 and the inner surface of the casing 3 forms a thermally insulating layer that tends to retain the contents of the liner 2 at its filling temperature during use. The insulating properties of the material of the liner 2 also assist this process. In a modification, the interior surface of the casing 3 and/or the outer surface of the liner 2 could be coated with a reflective coating to increase the thermally insulating properties of the assembly.

When suspended in the outer casing, the top of the liner 2 is flush or stands slightly proud of the rim 21 of the casing and defines an, annular upper surface over which can be located the teat 5 or, if used, the swirler 7. In the latter case the teat 5 is then located over the swirler 7 and both are held in place, together with the liner 2, by the sealing ring 6 that locates over the teat 5 and screws to a thread 22 that is moulded into the exterior surface of the casing 3, adjacent the rim 21. The screw-fitment of the ring 6 to the casing 2 ensures that the attachment of the liner 2, swirler 7 and teat 5 thereto can be sufficiently tight to prevent leakage of the feed through the joint. The use of the depending flange 19 means that the teat 5 only need touches the liner 2 or the swirler 7 which also removes the need for the sealing ring 6 or the outer casing 3 to be sterilized when using the bottle assembly for a second feed.

Preferably, the surfaces 2*a* and 2*b* of the liner the will lie adjacent the rim of the teat and the upper rim of the casing 3 respectively are profiled to increase the frictional engagement of the liner with the rim of the teat 5 and the casing 3. This prevents or reduces relative rotation between the liner 2 and the casing 3 or the teat 5 when the bottle is being assembled and the sealing ring 6 is secured to the casing. The profiling can comprise ridges or teeth or in a more sophisticated arrangement, the profiling can comprise a fish-scale type arrangement which in one direction allow slippage between the surfaces 2*a*, 2*b* of the liner 2 and the teat 5 and the casing 3 but in resist relative rotation in the opposite direction.

In an alternative arrangement, the depending flange 19 of the liner 2 can be provided with one or more cut-outs 19*a*, as shown in FIGS. 3*a* and 3*b* in which one or more projections on the casing 3 can engage to prevent relative rotation between the liner 2 and the casing 3. Such an arrangement also ensures that the liner 2 is positioned correctly within the casing 3.

When used, the swirler 7 is a mixing device in the form of a disc or plate in which are formed a series projections such as raised blades 23*a* with apertures 23*b* through which feed must pass to enter the teat 5. The blades 23*a* force the feed to swirl as it passes through apertures 23*b*, which tends to break up any lumps of powdered milk in the feed and to mix the powder with the liquid of the feed during feeding. If the feed does not comprise a powder formulation, the swirler 7 can be omitted and the sealing ring 6 screwed down further over the edge of the teat 5 and the liner 2 to ensure a liquid-tight joint.

Figure 5:
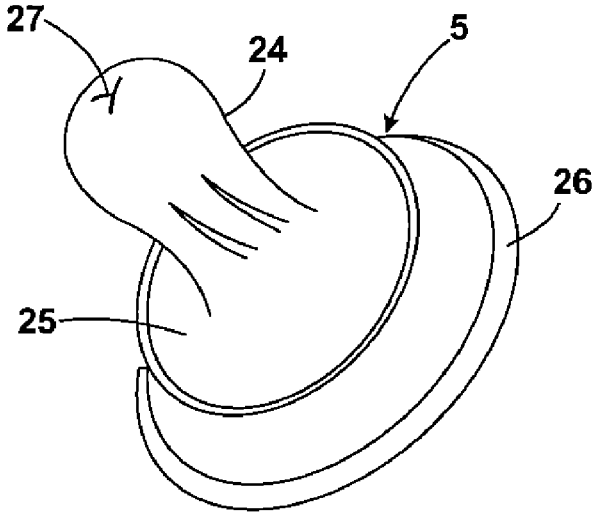
FIG. 5 is a perspective view of a teat forming part of the assembly shown in FIGS. 1 and 2.

The teat 5 is preferably of the form shown in FIG. 5 and, like the liner, is also moulded from a food-grade silicone or a food-grade thermoplastic elastomer. This shows a teat 5 of conventional shape with a nipple 24 that is surrounded by an areola portion 25, that may be dimpled or otherwise textured as at 25*a* (as shown in FIG. 2) to provide a life-like feel, and an outer rim 26 that is engaged by the sealing ring 6 to secure the teat 5 to the casing 3. Located centrally of the nipple 24 is a slit 27 through which the feed is sucked. Preferably, the slit 27 has a Y-shape. It has been found this shape of slit 27 readily opens up when the nipple 24 is sucked so that feed can pass therethrough but is self-closing once the negative pressure exerted on the nipple 24 during feeding ceases. This prevents air from being sucked into the liner 2 during any breaks in feeding and also prevents leakage of the feed out of the liner 2.

When not in use, the teat 5 can be covered by the seal cap 8, which fits over the teat and push-fits around the top of the sealing ring 6. The cap 8 is shaped with tapering sides such that at least its upper part has a diameter less than the diameter of the casing 3. At the base of the bottle assembly is the detachable base 4, that snap fits over a pair of projecting annular ribs 28 that are integrally moulded around the lower rim 28 of the casing 3. As shown in FIG. 2, the lower rim 29 of the casing 3 may comprise a region of smaller diameter than the central portion so that the base 4 fits substantially flush with the outer contour of the casing 3. The diameters of the upper part of the sealing ring 6 and of the base 4 are made identical so that the seal cap 8 can be push-fitted to either the sealing ring 6, in order to cover the teat 5, or in an inverted condition to the base 4 to form a stand for the bottle assembly. The latter arrangement is described in more detail below with reference to FIG. 6*a*. In a modified arrangement, the detachable base 4 can be made with a screw-fit to the base of the casing 3.

Figure 6C:
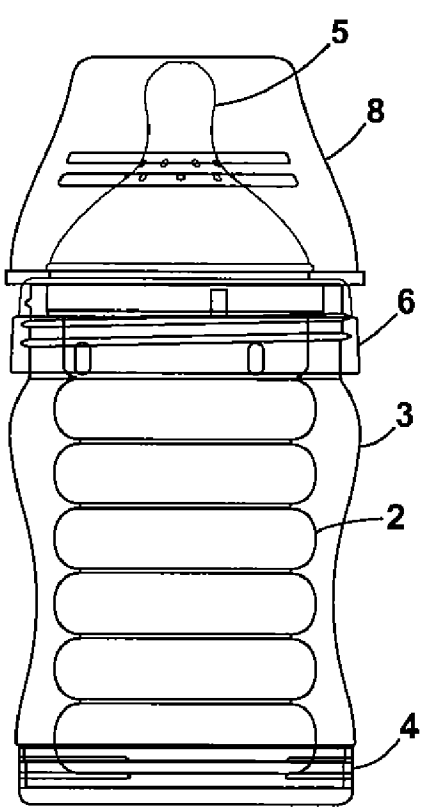
FIGS. 6*a* to 6*c* are schematic side elevations of the assembly shown in FIG. 1 showing a sequence of events during filling of the assembly with a feed.
Figure 6B:
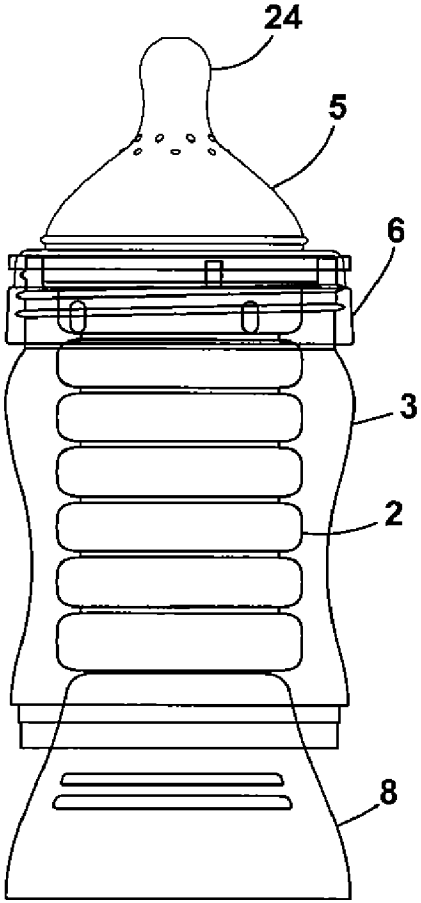

In use and once sterilized, a pair of tongs should be used to insert the liner 2 into the outer casing 3. The tongs can also be used to place the sealing ring 6 over the teat 5, which can be pulled through the ring 6 so that the ring 6 locates around the rim 26. The liner 2 can then be filled with an appropriate quantity of feed. If using a swirler 7, this should be located in position over the top of the liner 2 using the tongs and then the sealing ring 6, together with the teat 5, should be placed over the top of the liner 2 and the swirler 7, if present, before being screwed firmly to the casing 3. Air within the liner 2 and the teat 5 can then be expelled by holding the bottle assembly 1 upright and by manually pushing the base of the liner 2 upwards through the open base of the casing 3. This reduces the volume of the liner 2, expelling air through the teat in the process. Finally, the base 4 should be snap-fitted over the bottom of the casing 3 to cover and to protect the lower portion of the liner 2. However, the bottle assembly has been designed so that air trapped within the liner 2 and the teat 5 can be expelled prior to feeding without the user having to manually squeeze the liner 2. This process can be described with reference to sequence of drawings comprising FIGS. 6*a* to 6*c*.

Figure 6A:
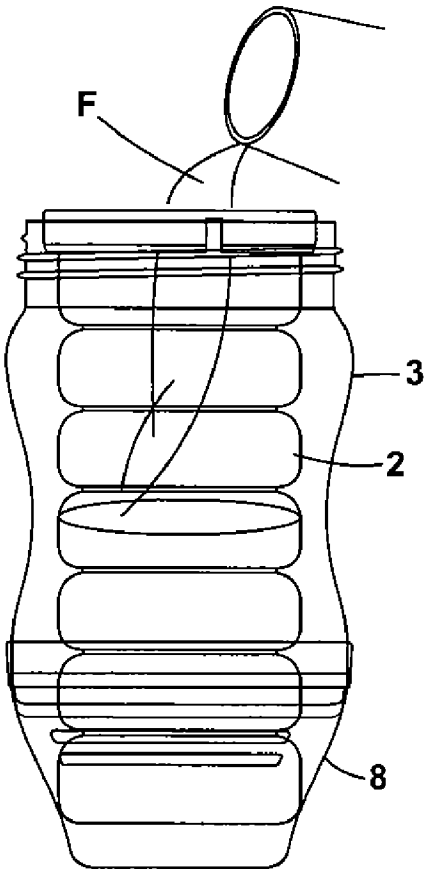

First, as shown in FIG. 6*a*, the assembled casing 3 and liner 2 are located over the top of the upturned seal cap 8 which push-fits to the base 4 to form a stand for the bottle assembly. The liner 2 can then be charged with the feed F. As the seal cap 8 is inverted, this enables the liner 2 to expand downwards as it is filled so that it protrudes out of the casing 3 into the upturned cap 8 below the lower level of the casing 3. When sufficient feed has been poured into the liner 2, the teat 5, swirler 7 if used, and the sealing ring 6 should be fitted to the casing 3 as described above. The seal cap 8 can then be detached from the casing 3 and inverted so that its flat top can be used to push the liner 2 back into the casing 3. This will force air out of the liner 2 and the teat 5. Preferably, the volume of the cap 8 into which the liner 2 can expand during filling equals the volume of the teat 5 so that when the liner 2 is pushed back into the casing 3 only the air in the teat 5 is forced out, without wasting any of the feed. In an alternative arrangement, simply securing the base 4 to the casing 3 may also remove the unwanted air from the liner 2 and the teat 5.

Once all the air has been expelled, the base 4 can be attached to the casing 3 and the bottle assembly is ready for use. As described above, the Y-shaped slit 26 in the teat 5 is self-sealing so that once the air has been expelled from the liner 2 and teat 5, air is not sucked back therein once the pressure on the liner 2 is removed. As all of the air has been expelled from the liner 2 and the teat 5, the bottle can also be used in any orientation as the feed 29 will always remain in contact with the nipple 24 of the teat 5. During use, as feed is removed from the liner 2 it contracts in volume but owing to its shape it always contracts in the manner of a bellows by reducing in length along its longitudinal axis.

Figures 7A, 7B, 7C:
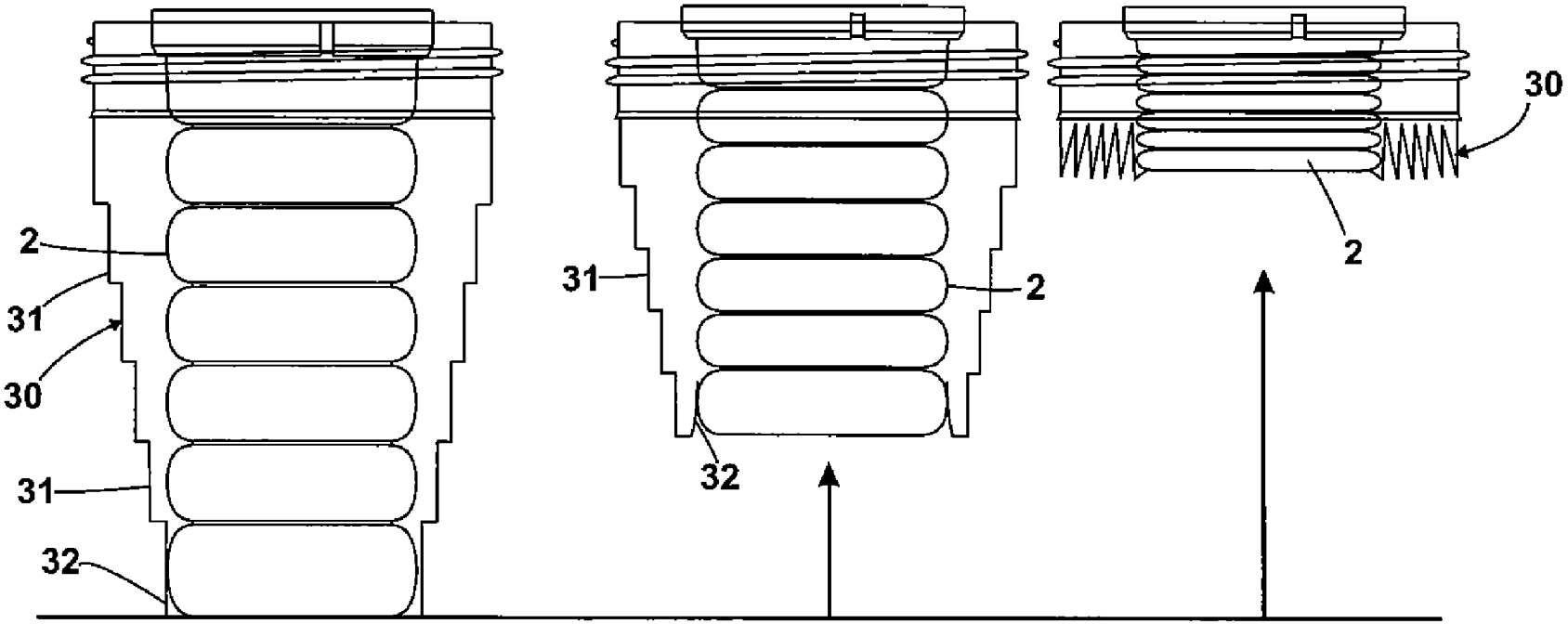
FIGS. 7*a* to 7*c* are schematic side elevations of a modified form of outer casing for use in an assembly in place of the outer casing shown in FIGS. 1 and 2 and showing a sequence of events during emptying of the assembly.

In an alternative bottle assembly the outer casing 2 of the assembly can be replaced by a casing 30 as shown schematically in FIGS. 7*a* to 7*c*. Here the casing 30 is telescopic, being made of a plurality of rigid sections 31 which are connected together but which can nest within one another. In this assembly, the base 4 can be dispensed with as the casing 30 comprises a container with a base section 32. In use, when sufficient feed has been poured into the liner 2, the teat 5, swirler 7 if used, and the sealing ring 6 are fitted to the casing 3 as before (this is not shown in FIGS. 7*a* to 7*c*). The base section 32 of the casing 30 is then pushed inwardly of the rest of the casing as shown in FIG. 7*b* so that air within the liner 2 and the teat 5 is expelled. The bottle assembly is then ready for use. Then, as the liner 2 empties and contracts in length, the outer casing 30 can also contract in length until ultimately, it and the liner 2 are both completely collapsed as shown in FIG. 7*c*. Whilst a telescopic outer casing 30 is shown in FIGS. 7*a* to 7*c*, it will be appreciated that other forms of outer collapsible casings could be used. For example, the outer casing could also collapse and expand in the manner of a bellows in a similar way to the liner but in a more rigidly controlled manner so that the casing 30 could hold its shape at any particular stage during the collapsing process. This collapse could take place is an even manner along its length, like a bellows or concertina, or could take place section by section upwardly from the base.

Figure 9:
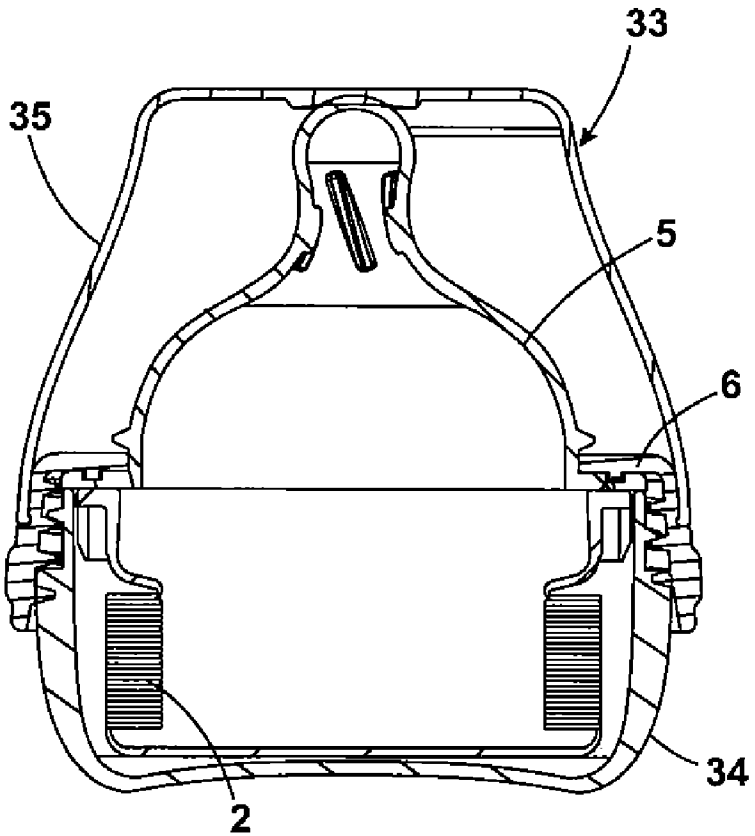
FIG. 9 is a longitudinal cross-section along through the carrying case shown in FIG. 8.
Figure 8:
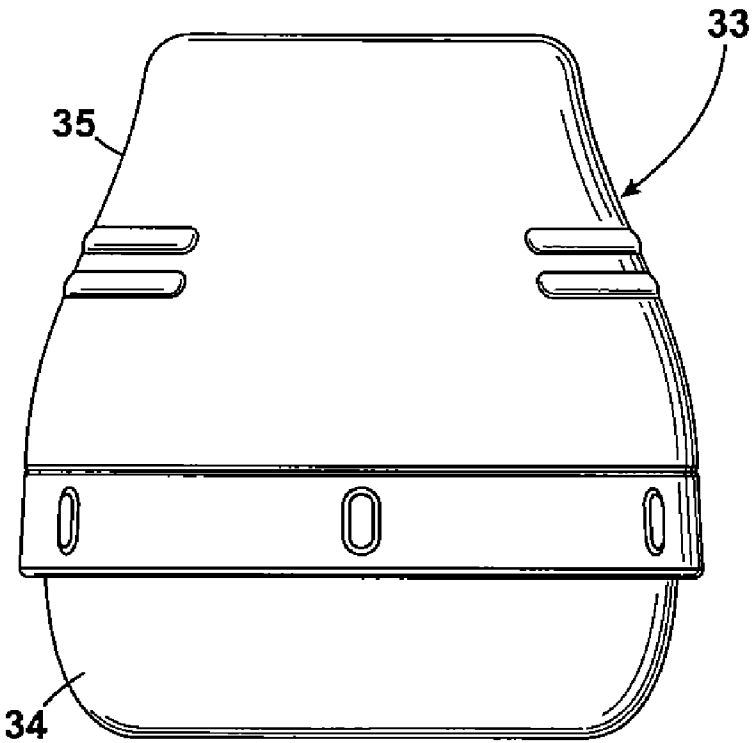
FIG. 8 is a side elevation view of a carrying case for use in combination with the nursing bottle assembly shown in FIG. 1.
Figure 10:
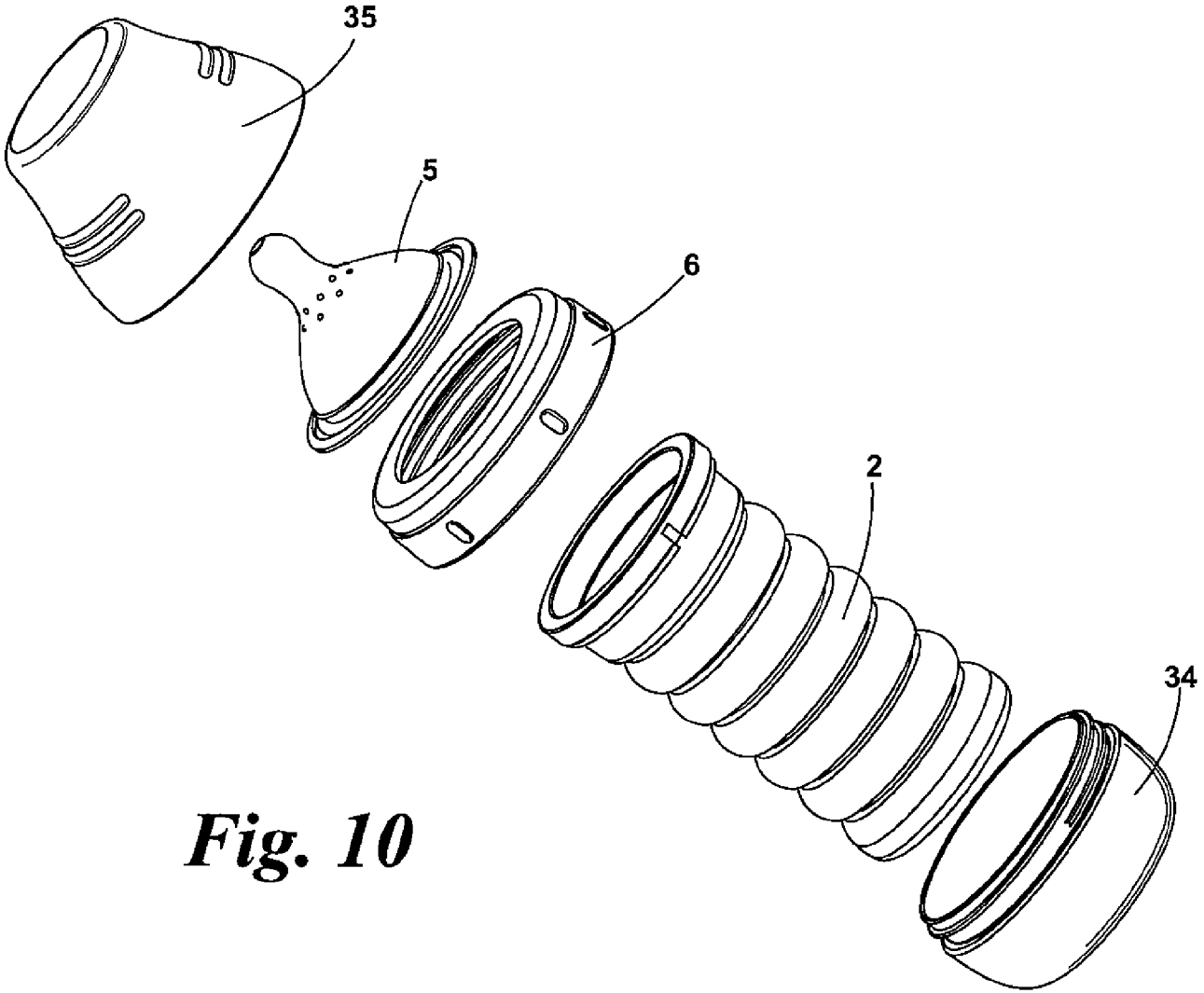
FIG. 10 is an exploded, perspective view of the carrying case and its contents as shown in FIGS. 8 and 9.

The flexibility of the inner liner 2 and the mode by which it collapses enable the bottle assembly of the present invention to be used in combination with a travelling case 33 for carrying a pre-sterilized liner and teat 5 as shown in FIGS. 8 to 10. It will be appreciated that when travelling, it may be necessary to carry the means for providing a plurality of feed to a baby or infant. If during the journey it will not be possible to sterilize a liner 2 and teat 5, which are the parts of the bottle assembly which come into contact with the feed then it is necessary to carry pre-sterilized liners 2 and teats 5, and possible also pre-sterilized sealing rings 6, along with one. The case 33 that will now be described enable this to be carried out in an efficient manner.

As shown in FIGS. 8 to 10, the transportable assembly comprises a pre-sterilized, collapsed liner 2, teat 5 and sealing ring 6 which are located within the case 33 that comprises a base 34 and a screw-on lid 35. A pair of sterilized tongs (not shown) can also be located within the lid 35 and, if necessary, a swirler 7 can also be located within the case 33. As can be seen in FIG. 9, the liner 2 is stored within the assembly in a collapsed manner so that it takes up the minimum amount of space. However, when required, the case 33 can be opened and the contents used with the outer casing 3 and base 4 of a bottle assembly 1 as described above to provide a second feeding assembly for an infant, the casing 3 and the base 4 not requiring sterilization prior to reuse. In a modified arrangement, as a collapsed liner 2 still maintains a diameter similar to that of an expanded liner 2, even less space can be taken up in a travelling arrangement by inverting a teat 5 so that the nipple 24 is located within the interior of the liner 2 and the rim 26 of the teat abuts the rim of the liner 2. In this arrangement the lid 35 need not comprise a dome shape but comprise a simple, conventional screw-on lid. It is also possible to provide a stack of cases 33, each containing a collapsed liner 2, inverted teat 5 and sealing ring 6 for use with a single bottle assembly to enable a plurality of feeds to be provided.

We claim:

1. A nursing bottle assembly comprising:

a rigid outer casing defining a channel around an upper rim thereof;

a flexible inner liner comprising a container with a rim, said rim having a depending flange extend around said rim, said depending flange fitting into said channel of said outer casing such that said inner liner is suspended therefrom and hangs down into said outer casing when said outer casing is upright, said container being of a bellows configuration such that said container expands and contracts relative to a longitudinal axis of said container;

a teat; and a sealing ring attached to said outer casing so as to secure said inner liner in a position within said outer casing, said inner liner having a top defining an annular surface over which a rim of said teat resides, at least one of said annular surface adjacent said rim of said teat and said upper rim of said outer casing being profiled with projections so as to increase frictional engagement of said inner liner with said teat and of said inner liner with said casing respectively.

2. The nursing bottle of claim 1, wherein the inner liner comprises a substantially cylindrical container formed with at least one projecting rib or groove about which the inner liner folds to enable said inner liner to expand and collapse in a predictable linear manner along said longitudinal axis.

3. The nursing bottle of claim 2, wherein the inner liner comprises a series of parallel annular projecting ribs between which the inner liner bulges in the opposite direction to define a series of bulging portions.

4. The nursing bottle of claim 3, wherein each of the bulging portions has a volume of between 28 milliliters and 32 milliliters when the liner is expanded.

5. The nursing bottle of claim 3, wherein the annular ribs project inwardly of the inner liner and the inner liner bulges outwardly between the ribs.

6. The nursing bottle of claim 1, wherein the inner liner is moulded from a food-grade silicone or a food-grade thermoplastic elastomer.

7. The nursing bottle of claim 1, wherein the sealing ring screws to a thread formed in the exterior surface of the outer casing to compress the rims of the inner liner and the teat to form a liquid-tight joint.

8. The nursing bottle of claim 1, wherein the depending flange of the inner liner defines one or more cut-outs in which one or more projections on the casing engage to prevent relative rotation between the inner liner and the outer casing when the sealing ring is secured to the outer casing.

9. The nursing bottle of claim 1, wherein a mixing device is interposed between the teat and the inner liner through which a feed within the inner liner must pass to exit through the teat.

10. The nursing bottle of claim 9, wherein the mixing device comprises a disc defining a series of apertures and projecting formations that cause the feed to swirl.

11. The nursing bottle of claim 1, wherein the teat comprises a nipple with a Y-shaped slit.

12. The nursing bottle of claim 11, wherein the teat comprises an areola portion surrounding the nipple that is dimpled or textured.

13. The nursing bottle of claim 1, wherein the outer casing is tubular and has a base is detachably connected to a lower rim of the outer casing.

14. The nursing bottle of claim 13, wherein the base snap-fits or screws to the lower rim of the outer casing.

15. The nursing bottle of claim 1, further comprising:

a cap which fits over the teat and push-fits around the sealing ring.

16. The nursing bottle of claim 15, wherein the cap is shaped with tapering sides such that at least an upper part thereof has a diameter less than the diameter of the outer casing in order that the cap can be inserted into the lower rim of the outer casing to exert pressure on the inner lining.

17. The nursing bottle of claim 15, wherein the cap can be inverted and attached to a lower rim of the outer casing to form a stand into which the inner liner can extend below the lower rim of the outer casing.

* * * * *